US008744313B2

(12) United States Patent
Miura

(10) Patent No.: US 8,744,313 B2
(45) Date of Patent: Jun. 3, 2014

(54) IMAGE FORMING APPARATUS

(75) Inventor: Shusuke Miura, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 482 days.

(21) Appl. No.: 13/080,102

(22) Filed: Apr. 5, 2011

(65) Prior Publication Data

US 2011/0249988 A1 Oct. 13, 2011

(30) Foreign Application Priority Data

Apr. 7, 2010 (JP) ..... 2010-088446

(51) Int. Cl.
*G03G 15/00* (2006.01)

(52) U.S. Cl.
USPC ..... 399/167; 4/412 R; 4/457; 4/458; 4/460; 4/462; 4/465; 475/344

(58) Field of Classification Search
USPC ..... 399/167; 475/344; 74/412 R, 457, 458, 74/460, 462, 465
See application file for complete search history.

(56) References Cited

U.S. PATENT DOCUMENTS

| | | | | |
|---|---|---|---|---|
| 618,272 | A * | 1/1899 | Johnson | 74/462 |
| 2,682,760 | A * | 7/1954 | Shenk | 464/154 |
| 3,043,158 | A * | 7/1962 | Herr, Jr. | 74/462 |
| 3,881,365 | A * | 5/1975 | Hardy | 74/462 |
| 3,905,737 | A * | 9/1975 | van der Lely et al. | 425/363 |
| 5,222,406 | A * | 6/1993 | Shigeura | 74/410 |
| 6,253,047 | B1 * | 6/2001 | Hildebrand et al. | 399/167 |
| 6,289,586 | B1 * | 9/2001 | Casella et al. | 29/893.1 |
| 7,921,745 | B2 * | 4/2011 | Takumori | 74/462 |
| 2007/0137355 | A1 * | 6/2007 | Ohmi et al. | 74/462 |
| 2008/0196530 | A1 * | 8/2008 | Shimada et al. | 74/457 |
| 2009/0279926 | A1 * | 11/2009 | Yahagi | 399/308 |
| 2010/0011895 | A1 * | 1/2010 | Ohmi et al. | 74/462 |

FOREIGN PATENT DOCUMENTS

| | | | | |
|---|---|---|---|---|
| JP | 60024243 | A * | 2/1985 | B21H 5/00 |
| JP | 03069844 | A * | 3/1991 | F16H 55/08 |
| JP | 04022799 | A * | 1/1992 | F04D 25/02 |
| JP | 2002273759 | A * | 9/2002 | B29C 45/17 |
| JP | 2003166601 | A * | 6/2003 | F16H 1/06 |
| JP | 2004-258353 | A | 9/2004 | |

* cited by examiner

*Primary Examiner* — Ryan Walsh
(74) *Attorney, Agent, or Firm* — Fitzpatrick, Cella, Harper & Scinto

(57) ABSTRACT

An image forming apparatus driving unit includes a rotatable member which is rotatably supported, a pair of bearing portions for rotatably supporting the rotatable member, and a motor for driving the rotatable member. In addition, a driving gear is provided on a driving shaft of the motor, and a driven gear, provided outside the pair of bearing portions with respect to a rotational axis direction of the rotatable member, engages with the driving gear to be rotated integrally with the rotatable member. At least one of the driven gear and the driving gear has, with respect to the rotational axis direction of the rotatable member, a crown shape so that a central tooth surface of a tooth projects more than end tooth surfaces of the tooth at a side where the driven gear and the driving gear engage each other. During driving of the driving gear, a first position where a pressure received by the tooth surface is at a maximum and a second position where an amount of crowning formed on the driven gear or the driving gear is at a maximum are offset in a same direction.

9 Claims, 14 Drawing Sheets

(a) COMPARATIVE EMBODIMENT (b) EMBODIMENT 1

IMAGE FORMING APPARATUS

FIELD OF THE INVENTION AND RELATED ART

The present invention relates to an image forming apparatus in which a photosensitive drum or a belt unit is driven by a motor. Specifically, the present invention relates to crowning of a gear for transmitting a drive force of the motor to the photosensitive drum (photosensitive member) or the belt unit.

When the photosensitive drum provided in the image forming apparatus of an electrophotographic type caused speed non-uniformity, pitch non-uniformity of scanning lines has conventionally occurred on the photosensitive drum to lower an image quality.

In order to suppress the speed non-uniformity, Japanese Laid-Open Patent Application (JP-A) 2004-258353 discloses a constitution in which single reduction in speed is performed between a gear provided on a shaft of a motor for driving the photosensitive drum and a gear provided on a rotation shaft of the photosensitive drum. Thus by reducing the number of engagement between the gears, it is possible to suppress an increase in non-uniformity of the rotational speed of the photosensitive drum due to accumulation of dimensional tolerance (error) of the plurality of gears.

In recent years, in order to realize further image quality improvement, further suppression of a microscopic rotational speed fluctuation (speed non-uniformity) has been desired. For that reason, it is desired that a noise-like speed fluctuation occurring at an engagement frequency is suppressed by enhancing reproducibility of engagement every one gear. This is because minute speed fluctuation occurring at the engagement frequency causes the rotation non-uniformity of the photosensitive drum and appears as slight scanning line pitch non-uniformity on an image.

In JP-A 2004-258353, a constitution in which each of four photosensitive drums of a full-color image forming apparatus is provided with a single-stage gear reduction mechanism and is driven by an individual motor is disclosed. In this constitution, a tooth surface of a driven gear has been subjected to crowning such that a tooth thickness is gradually decreased toward both ends of the driven gear with respect to a gear thickness direction. As a result, the rotation non-uniformity is alleviated by obviating end tooth bearing (tooth end engagement) such that power transmission between a driving gear and the driven gear is performed at an edge of the driven with respect to the gear thickness direction (FIG. 6 of JP-A 2004-258353).

However, as a result of downsizing and weight reduction of the image forming apparatus in recent years, even when a driving system as described in JP-A 2004-258353 was employed, there has been a tendency to increase the speed fluctuation of the photosensitive drum.

Here, in order to alleviate the speed fluctuation, there are methods of enhancing mechanical rigidity of the entire mechanism, such as an increase in thickness of a shaft of the gear reduction mechanism, an increase in plate thickness of a supporting casing and an increasing in thickness of the gear to effect both end supporting.

However, in this case, the downsizing and weight reduction of the image forming apparatus are inhibited, so that an increase in cost of parts is caused.

SUMMARY OF THE INVENTION

A principal object of the present invention is to provide an image forming apparatus capable of realizing image quality improvement of an output image by suppressing minute speed fluctuation of a photosensitive drum in a gear reduction mechanism between a motor and the photosensitive drum without inhibiting downsizing and weight reduction of the image forming apparatus.

Accordingly, an aspect of the present invention is to provide an image forming apparatus comprising:

- a photosensitive member rotatably supported by a bearing portion provided on a supporting casing;
- a motor fixed on the supporting casing;
- a driving gear provided on the supporting casing; and
- a driven gear for being engaged with the driving gear to be rotated integrally with the photosensitive member, wherein the driven gear includes teeth each of which is crowned such that a tooth thickness is maximum at a maximum tooth thickness position with respect to the gear thickness direction, wherein a maximum force receiving position of the tooth where a force received by the driven gear from the driving gear is maximum when the photosensitive member is driven is different from the maximum tooth thickness position,
- wherein the tooth thickness decreases from the maximum tooth thickness position toward the maximum force receiving position at a first degree and decreases from the maximum tooth thickness position away from the maximum force receiving position at a second degree, by the crowning, and wherein the first degree is larger than the second degree.

These and other objects, features and advantages of the present invention will become more apparent upon a consideration of the following description of the preferred embodiments of the present invention taken in conjunction with the accompanying drawings.

Figure 4:
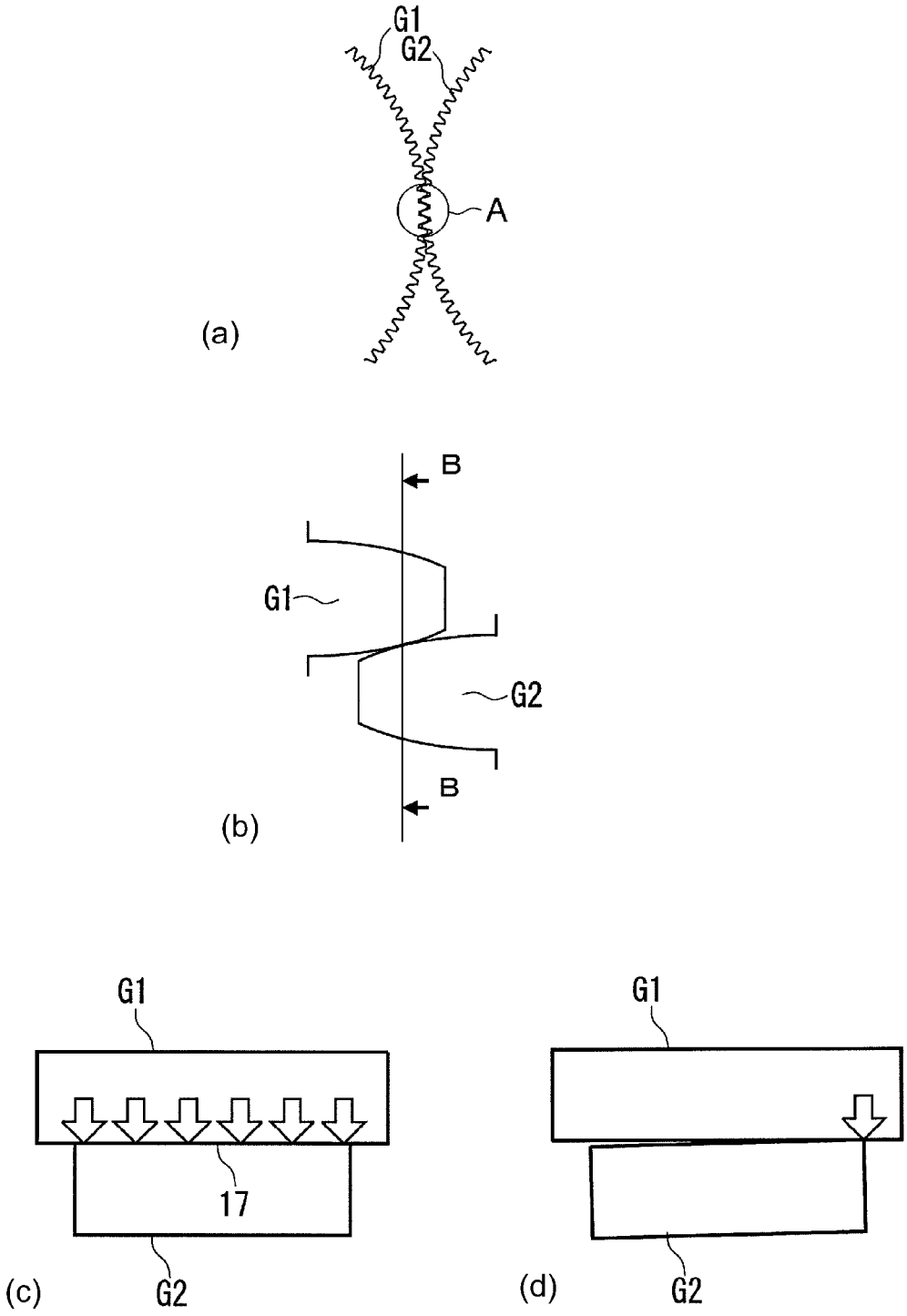

Parts (a) to (d) of FIG. 4 are illustrations of transmission between gears which have not been subjected to crowning.

Figure 5:
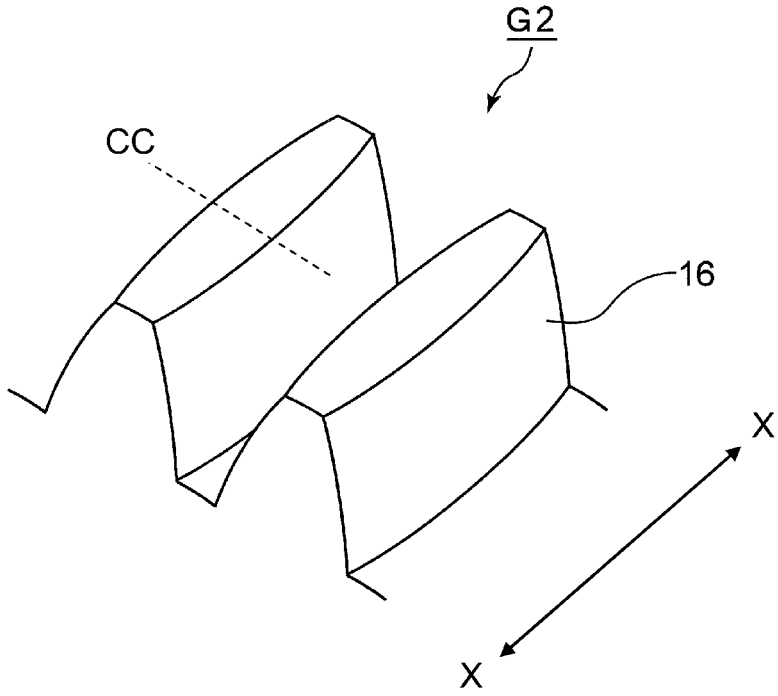

FIG. 5 is a perspective view of a driven gear which has been subjected to symmetrical crowning.

Figure 6:
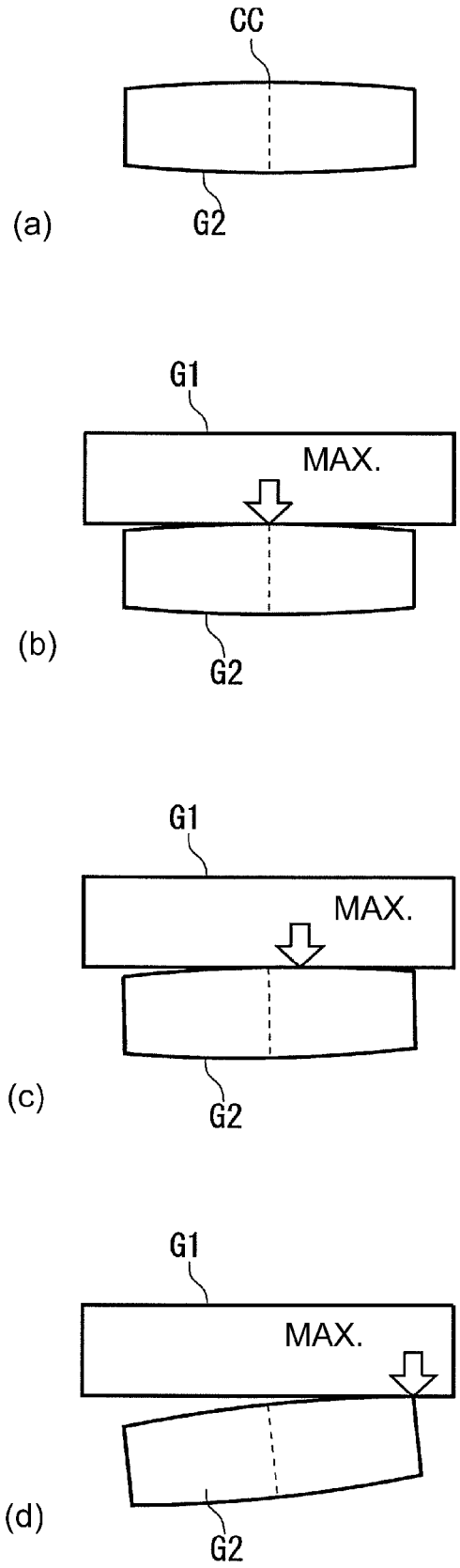

Parts (a) to (d) of FIG. 6 are illustrations of end tooth bearing of the driven gear which has been subjected to the symmetrical crowning.

Figure 7:
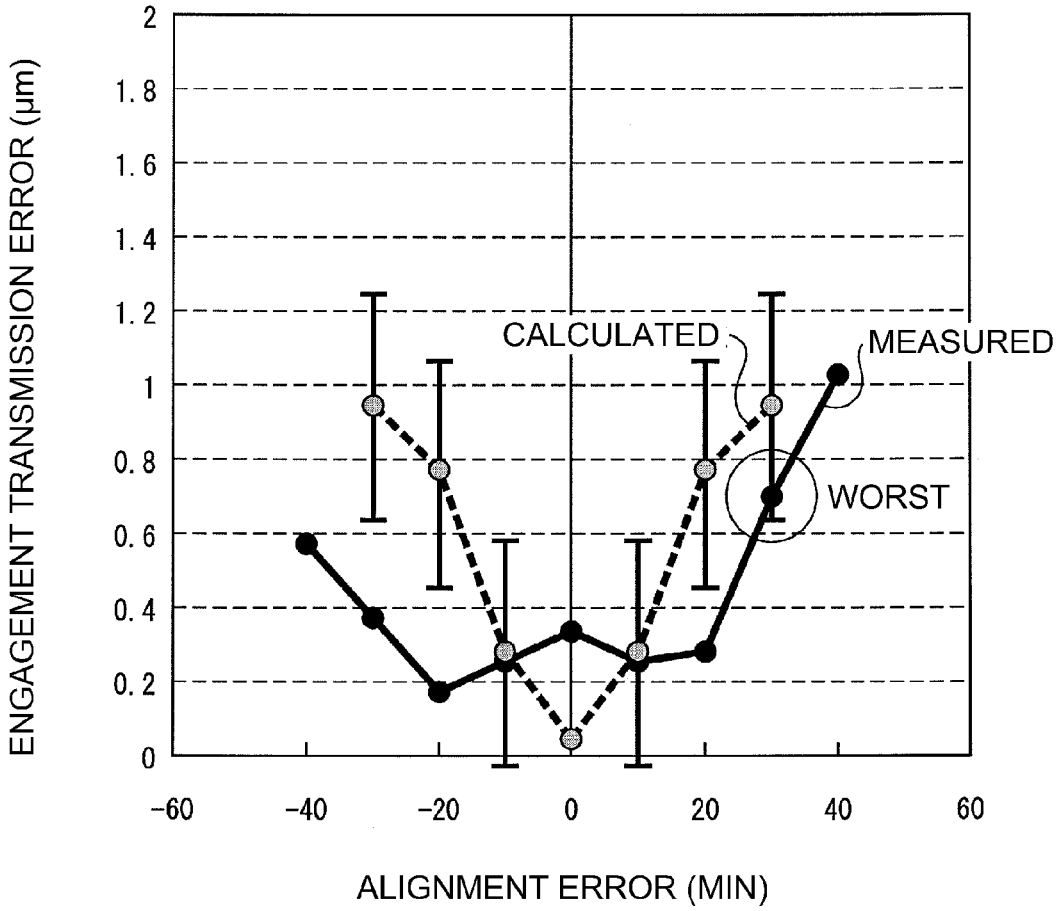

FIG. 7 is a graph showing a measurement result of an alignment error range in which the end tooth bearing does not occur.

Figure 8:
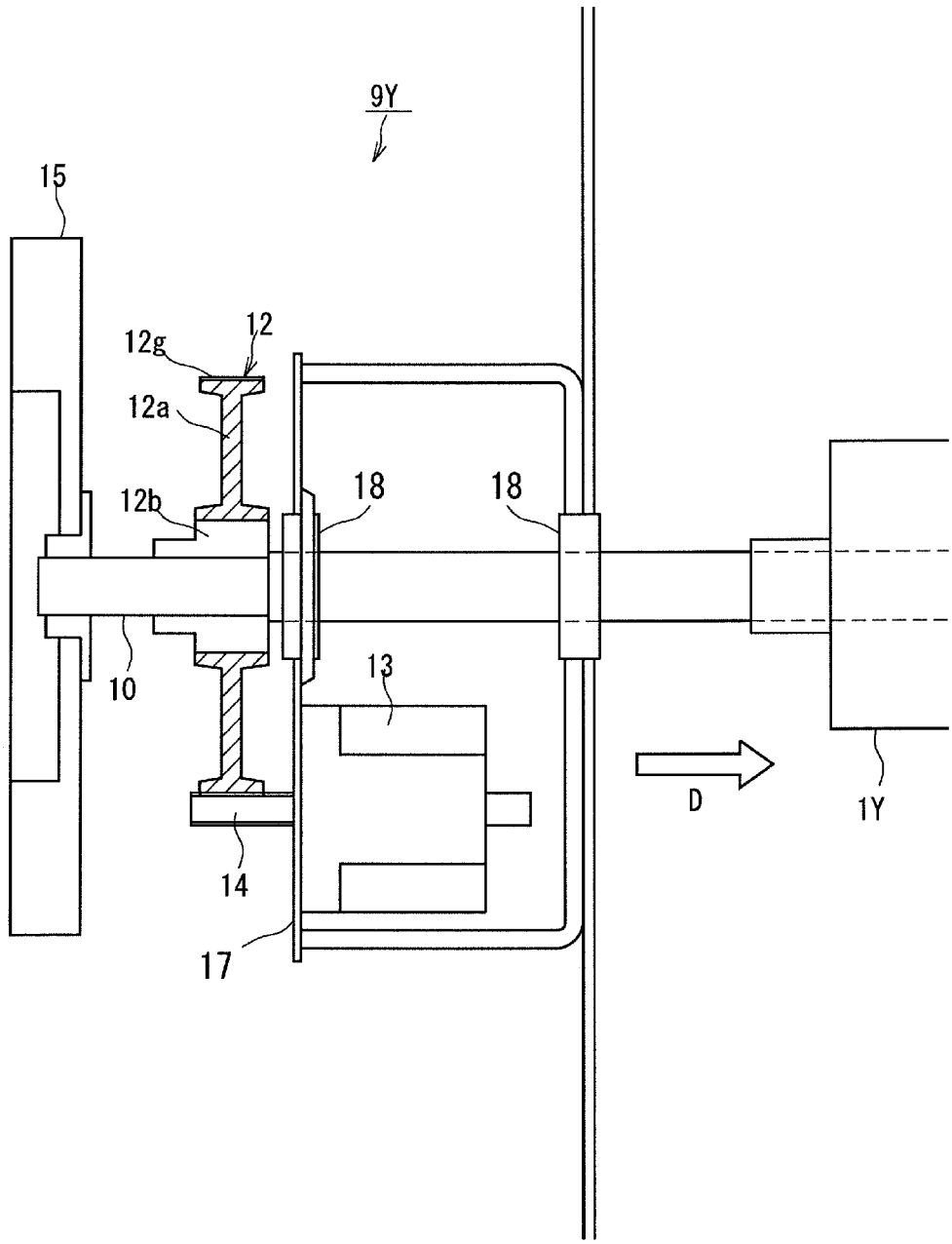

FIG. 8 is a partly enlarged view of the driving system of the photosensitive drum.

Figure 9:
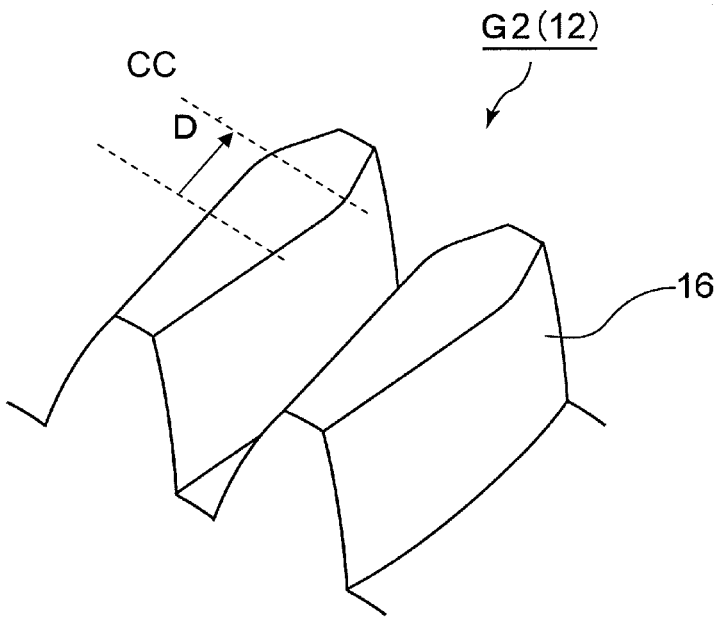

FIG. 9 is a perspective view of a driven gear which has been subjected to asymmetrical crowning.

Figure 10:
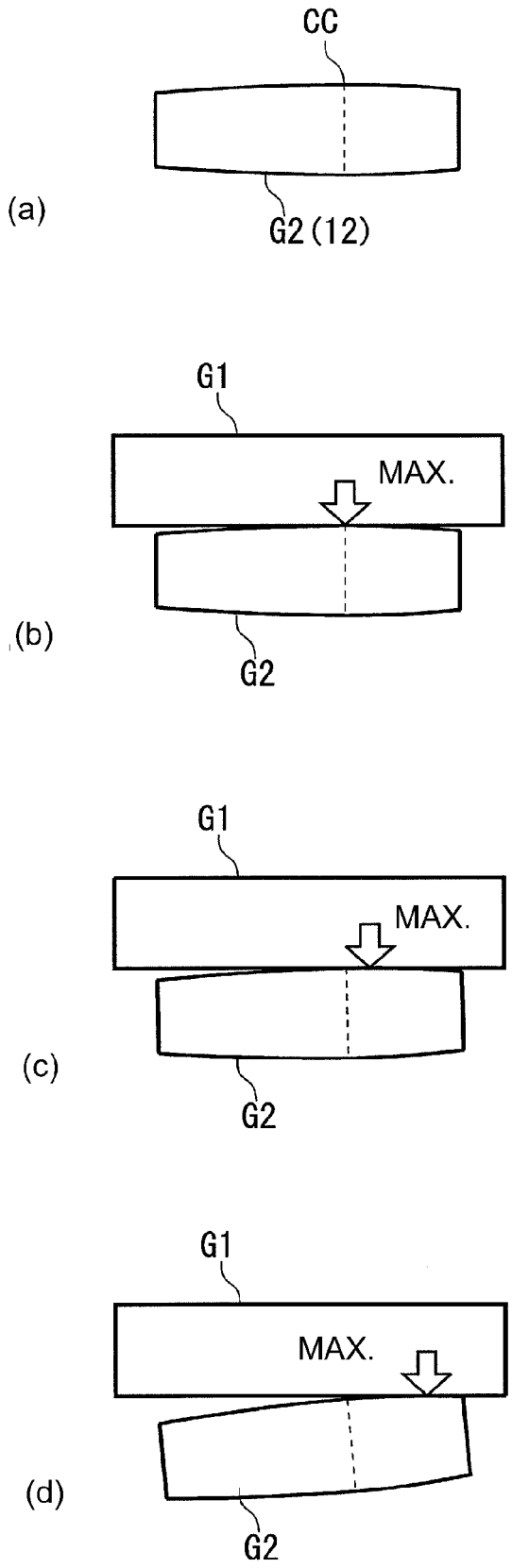

Parts (a) to (d) of FIG. 10 are illustrations of end tooth bearing of the driven gear which has been subjected to the asymmetrical crowning.

Figure 11:
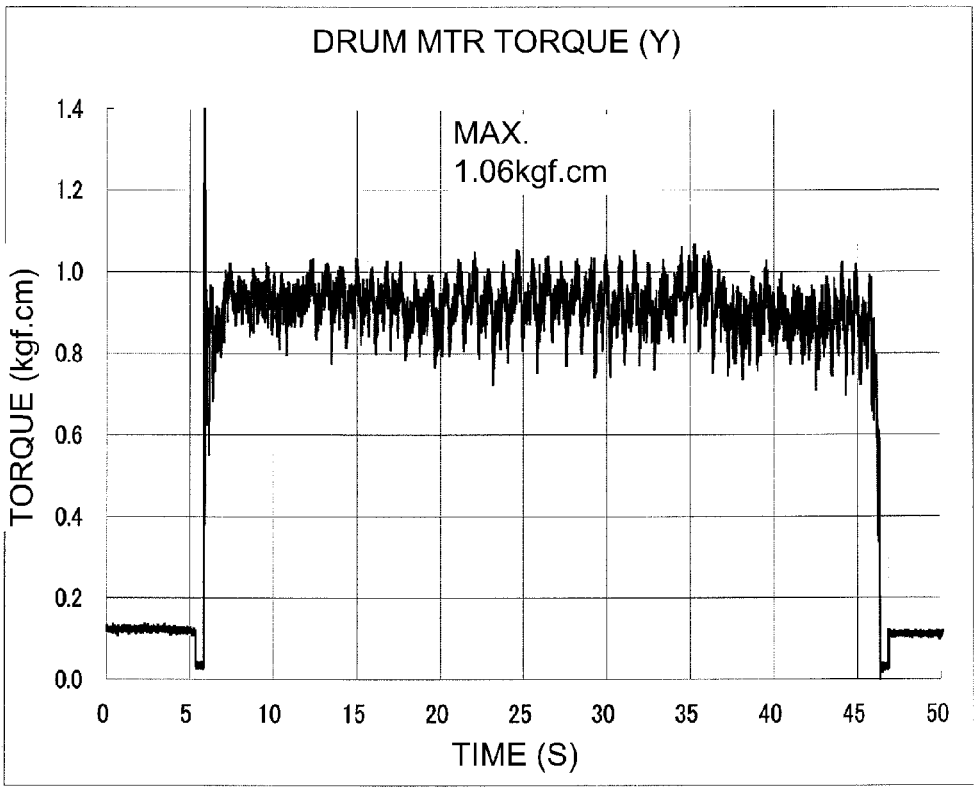

FIG. 11 is a graph showing a measurement result of a load torque of a drum motor.

Figure 12:
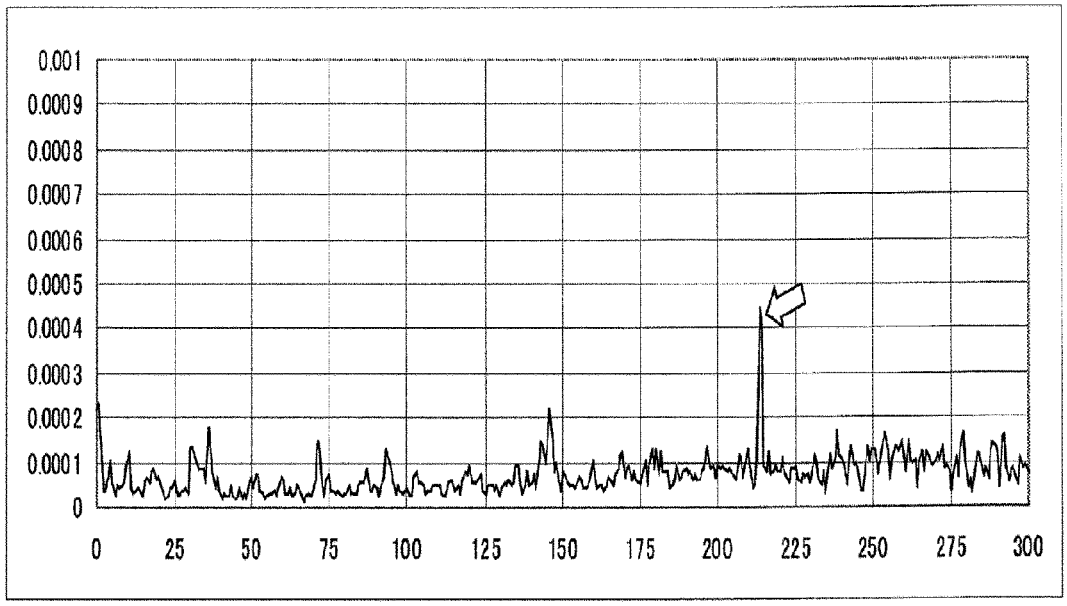
Figure 12:
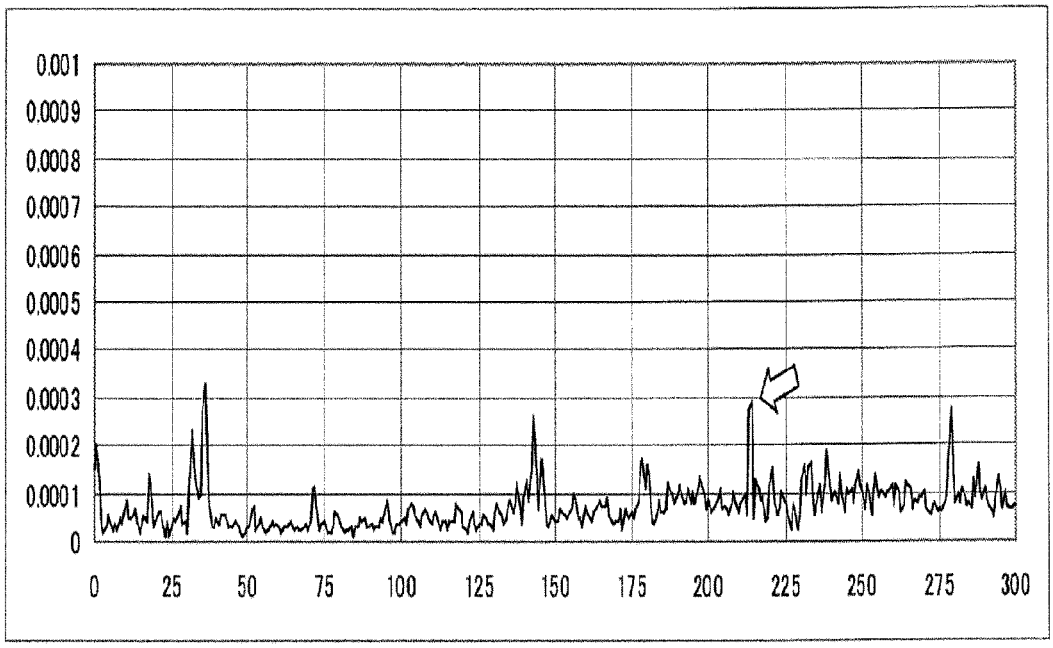

Parts (a) and (b) of FIG. 12 are graphs each showing a measurement result of a rotational speed fluctuation-reducing effect in Embodiment 1.

Figure 13:
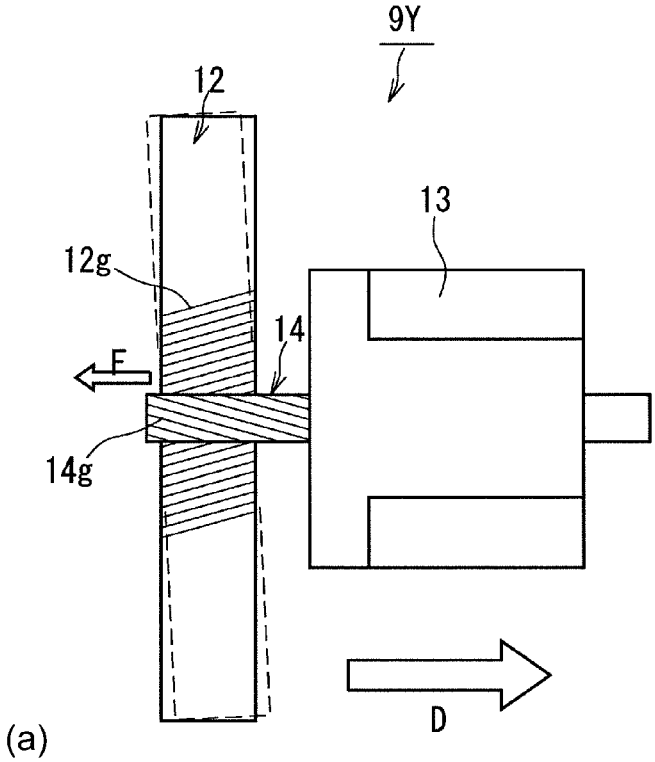
Figure 13:
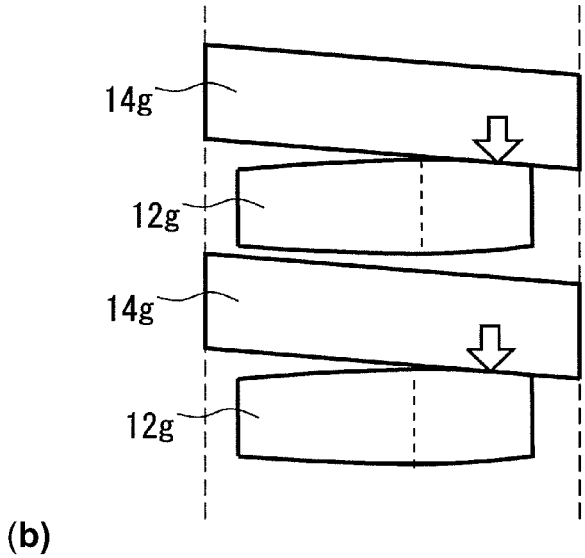

Parts (a) and (b) of FIG. 13 are illustrations of an amount of deformation of a drum gear.

Figure 14:
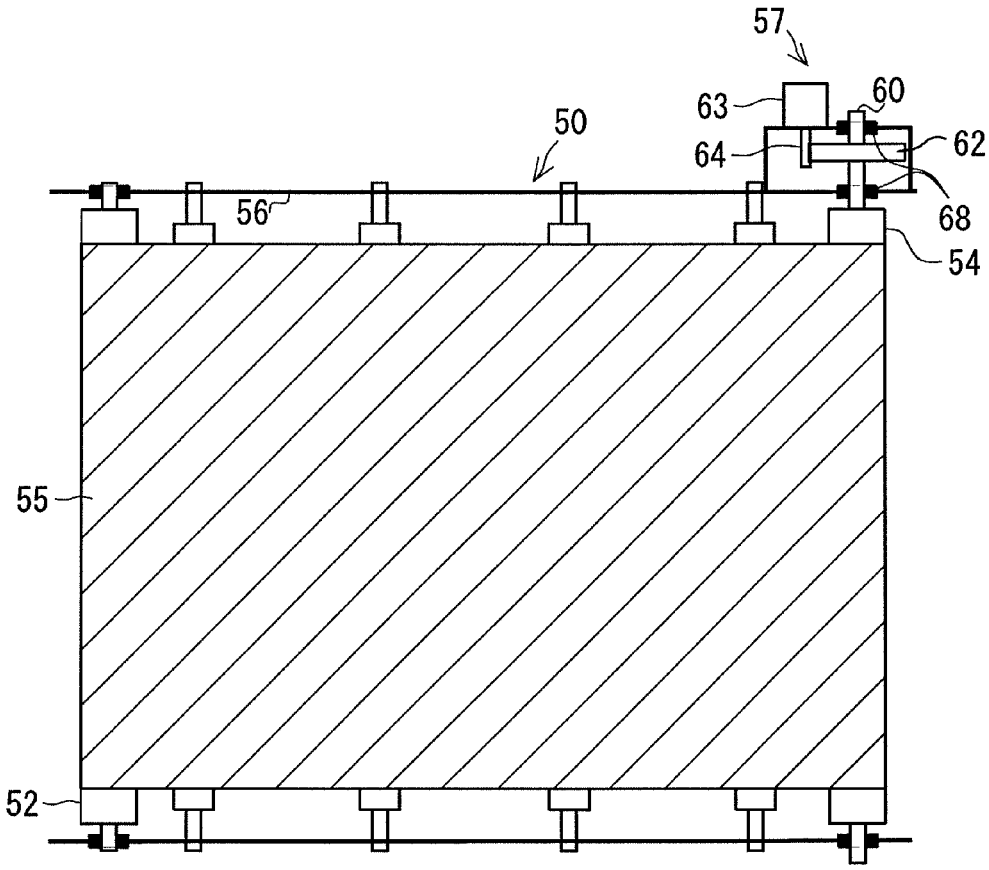

FIG. 14 is an illustration of a constitution of an intermediary transfer unit.

DESCRIPTION OF THE PREFERRED EMBODIMENTS

Hereinbelow, embodiments of the present invention will be described with reference to the drawings. The present invention can also be carried out in other embodiments in which a part or all of constitutions of the following embodiments are replaced with alternative constitutions so long as a gear of a rotation transmission system between a photosensitive drum and a motor has been subjected to asymmetrical crowning processing with respect to a gear thickness direction. Here, the gear thickness direction is a direction indicated by a double-pointed arrow X. Further, a position, with respect to the gear thickness direction, in which a thickness (tooth thickness) of one of teeth of the gear which has been subjected to the crowning processing is maximum is referred to as a crowning center CC (equivalent to a position in which an amount of the crowning is minimum).

Therefore, when an image forming apparatus including a photosensitive drum is used, the present invention can be carried out irrespective of a difference between a tandem type and a one-drum type and irrespective of a difference among an intermediary transfer type, a recording material conveying type and a direct transfer type. In the following embodiments, only a major part of the image forming apparatus relating to formation and transfer of the toner image will be described but the present invention can be carried out in various fields of apparatuses or machines such as printers various printing machines, copying machines, facsimile machines, and multifunction machines.

Incidentally, general matters of the image forming apparatuses described in JP-A 2004-258353 will be omitted from illustration and redundant explanation.

<Image Forming Apparatus>

Figure 1:
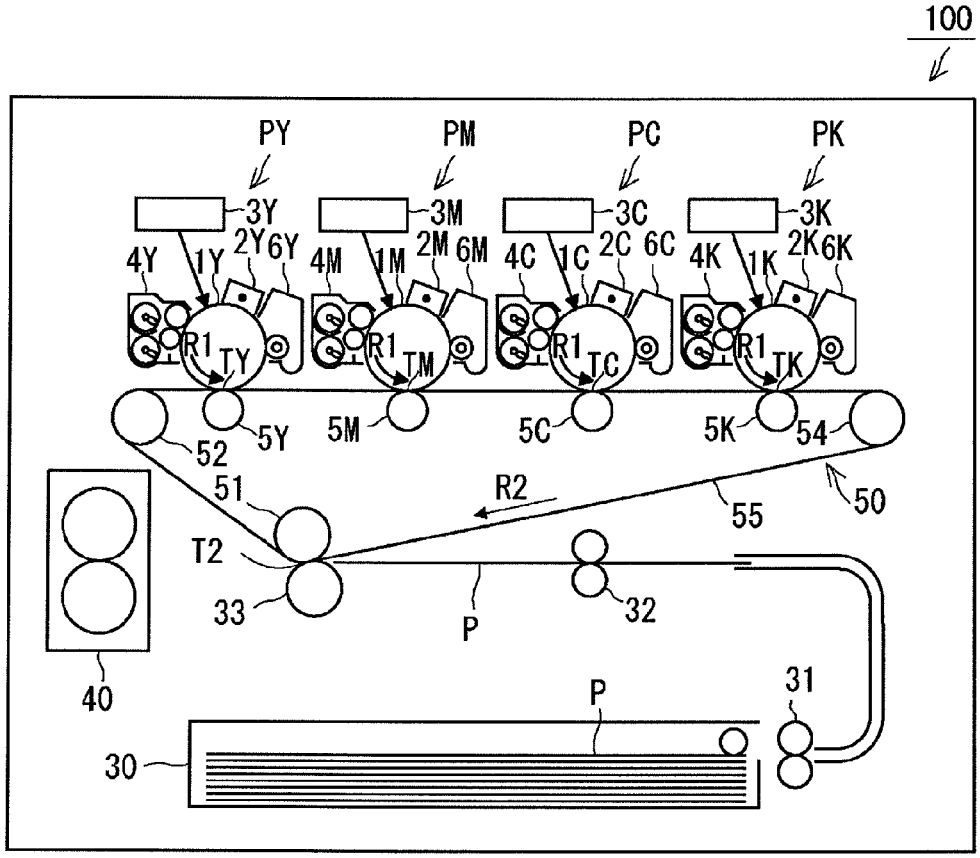
FIG. 1 is an illustration of an image forming apparatus.

FIG. 1 is an illustration of a structure of an image forming apparatus 100. As shown in FIG. 1, the image forming apparatus 100 is an intermediary transfer type full-color printer of the tandem type in which image forming portions PY for yellow, PM for magenta/PC for cyan, and PK for black are disposed along an intermediary transfer unit 50.

At the image forming portion PY, a yellow toner image is formed on a photosensitive drum 1Y and then is primary-transferred onto an intermediary transfer belt 55. At the image forming portion PM, a magenta toner image is formed on a photosensitive drum 1M and then is primary-transferred superposedly onto the yellow toner image on the intermediary transfer belt 55. At the image forming portions PC and PK, a cyan toner image and a black toner image are formed on a photosensitive drum 1C and a photosensitive drum 1K, respectively, and are similarly primary-transferred superposedly onto the intermediary transfer belt 55.

The four color toner images carried on the intermediary transfer belt 55 are conveyed to a secondary transfer portion T2, at which the four color toner images are collectively secondary-transferred onto a recording material P. The recording material P on which the four color-based full-color images are secondary-transferred is curvature-separated from the intermediary transfer belt 55 and is sent into a fixing device 40. The fixing device 40 heats and presses the recording material P, so that the toner images are fixed on a surface of the recording material P. Thereafter, the recording material P is discharged outside the image forming apparatus.

The image forming portions PY, PM, PC and PK have substantially the same constitution except that the colors of toners of yellow for a developing device 4Y provided at the image forming portion PY, of magenta for a developing device 4M provided at the image forming portion PM, of cyan for a developing device 4C provided at the image forming portion PC, and of black for a developing device 4K provided at the image forming portion PK are different from each other. In the following description, the image forming portion PY for yellow will be described and with respect to other image forming portions PM, PC and PK, the suffix Y of reference numerals (symbols) for representing constituent members (means) for the image forming portion PK is to be read as M, C and K, respectively, for explanation of associated ones of the constituent members for the image forming portions PM, PC and PK.

At the image forming portion PY, around the photosensitive drum 1Y, a corona charger 2Y, an exposure device 3Y, the developing device 4Y, a primary transfer roller 5Y and a drum cleaning device 6Y are disposed. The photosensitive drum 1Y is constituted by forming a negatively chargeable photosensitive layer on a substrate of an aluminum cylinder and is rotated at a predetermined process speed in a direction indicated by an arrow R1.

The corona charger 2Y electrically charges the surface of the photosensitive drum 1Y uniformly to a negative-polarity dark portion potential VD. The exposure device 3Y writes (forms) an electrostatic image for an image on the charged surface of the photosensitive drum 1Y.

The developing device 4Y reversely develops the electrostatic image formed on the photosensitive drum 1Y to form the toner image.

The primary transfer roller 5Y urges the inner surface of the intermediary transfer belt 55 to form a primary transfer portion TY between the photosensitive drum 1Y and the intermediary transfer belt 55. By applying a positive-polarity voltage to the primary transfer roller 5Y, the toner image carried on the photosensitive drum 1Y is primary-transferred onto the intermediary transfer belt 55.

The drum cleaning device 6Y rubs the photosensitive drum 1Y with a cleaning blade to collect transfer residual toner remaining on the photosensitive drum 1Y without being primary-transferred onto the intermediary transfer belt 55.

The intermediary transfer belt 55 is supported by being extended around a tension roller 52, a driving roller 54 and an opposite roller 51 and is driven by the driving roller 54, thus being rotated at the predetermined process speed in the direction indicated by an arrow R2.

A secondary transfer roller 33 is contacted to the intermediary transfer belt 55 which is supported by the opposite roller 51 at an inner surface, thus forming a secondary transfer portion T2. The recording material P pulled out from a recording material cassette 30 is separated one by one by a separation roller 31 to be sent to registration rollers 32. The registration rollers 32 receives the recording material P in a rest state to place the recording material P in a stand-by condition and then sends the recording material P to the secondary transfer portion T2 while timing the recording material P to the toner images on the intermediary transfer belt 55.

In a process in which the recording material P is nip-conveyed at the secondary transfer portion T2, the positive-polarity DC voltage is applied to the secondary transfer roller 33, so that the full-color toner images are secondary-transferred from the intermediary transfer belt 55 onto the recording material P.

<Gear Transmission Mechanism>

Figure 2:
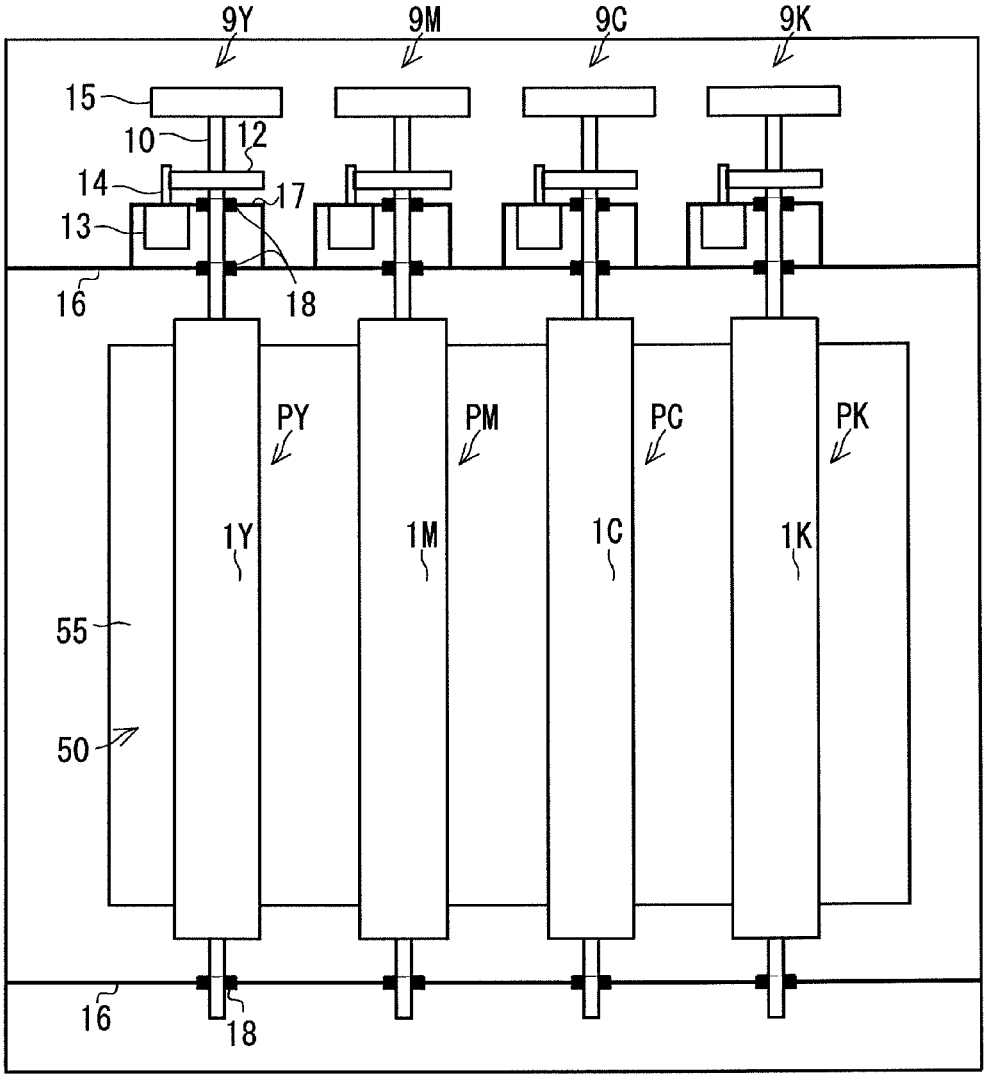
FIG. 2 is an illustration of a driving system of a photosensitive drum.
Figure 3:
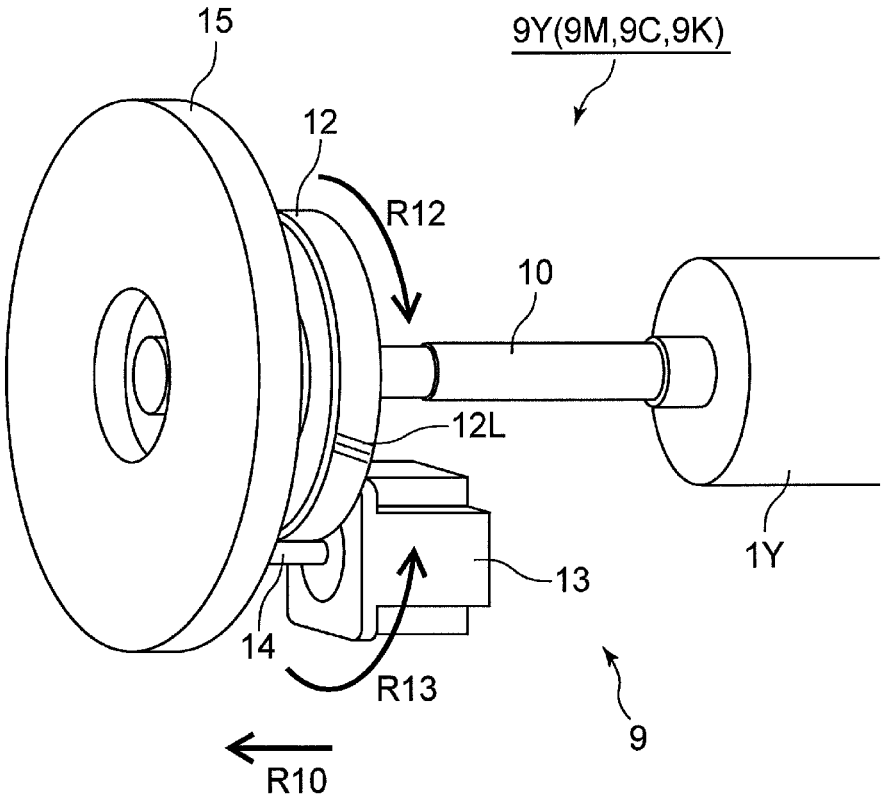
FIG. 3 is an enlarged perspective view of the driving system of the photosensitive drum.

FIG. 2 is an illustration of a driving system of the photosensitive drum. FIG. 3 is an enlarged perspective view of the driving system of the photosensitive drum.

As shown in FIG. 2, the photosensitive drums 1Y, 1M, 1C and 1K of the image forming portions PY, PM, PC and PK are individually rotated and driven by drum driving portions 9Y, 9M, 9C and 9K, respectively. The drum driving portions 9Y, 9M, 9C and 9K have the same constitution and are subjected to the same crowning with respect to their gear transmission mechanisms. Therefore, in the following description, the drum driving mechanism 9Y will be described.

A drum gear shaft 10 of the photosensitive drum 1Y which is an example of the photosensitive member is rotatably supported by a supporting casing 16 by using bearings 18. A drum motor 13 is fixed to the supporting casing 16, and a motor gear 14 which is an example of a driving gear is directly formed on a driving shaft of the motor 13. A drum gear 12 which is an example of a driven gear engages with the motor gear 14 and rotates integrally with the photosensitive drum 1Y. At an end of the drum gear shaft 10 of the photosensitive drum 1Y, where end tooth bearing is performed, a fly wheel 15 is provided for alleviating a rotational speed fluctuation by inertia.

As shown in FIG. 3, when the drum motor 13 is actuated, the motor gear 14 is rotated in a direction indicated by an arrow R13. The motor gear 14 and the drum gear 12 are engaged with each other, so that a rotational driving force of the motor gear 14 is transmitted to the drum gear 12. By the rotational driving force transmitted from the motor gear 14, portions consisting of the drum gear shaft 10, the photosensitive drum 1Y, the drum gear 12 and the fly wheel 15 are integrally rotated in a direction indicated by an arrow R12.

The motor gear 14 is formed by directly cutting an output shaft of the motor 13. Specifications of the motor gear 14 are an outer diameter of 9 mm, a module of 0.6, a pressure angle of 20 degrees, the number of teeth of 12, and an angle of twist of a helical gear of 20 degrees.

A gear portion of the drum gear 12 is formed by ejection molding of resin around a metal bearing portion. Specifications of the drum gear 12 are the outer diameter of 124 mm, a thickness of 18 mm, the module of 0.6, the pressure angle of 20 degrees, the number of teeth of 192, and the angle of twist of the helical gear of 20 degrees. A tooth surface of the helical gear is tilted in a direction indicated by a slid line 12L in FIG. 3. A disk portion of the drum gear 12 is decreased in thickness down to 6 mm, thus being reduced in weight.

Incidentally, as a factor of inhibiting the image quality improvement in the image forming apparatus 100, a rotational speed non-uniformity occurs due to an engagement transmission error caused by engagement between the motor gear 14 and the drum gear 12 for driving the photosensitive drum 1Y. Further, there is a problem such that the rotational speed non-uniformity appears on an output image as a pitch non-uniformity of scanning lines.

Therefore, in the gear transmission mechanism between the motor 13 and the rotation shaft of the photosensitive drum 1Y, the helical gear is employed in order to suppress the rotational speed non-uniformity by continuously transmitting a torque by the engagement of the gears.

Further, a reduction ratio of a gear transmission system is set at 10 or more to rotate the motor at high speed, so that output torque non-uniformity is alleviated. As the reduction ratio is increased, preferably by setting the reduction ratio at 10 or more, the influence of the rotation non-uniformity of the motor on the rotation speed of the photosensitive drum can be alleviated.

With respect to the gears such as a spur gear, shafts of engaging two gears may preferably be parallel to each other. However, it is actually difficult to realize completely parallel shafts due to a problem such as component tolerance. In the case where the spur gears which have not been subjected to the crowning processing are used, when the shafts thereof are parallel to each other, the tooth surfaces of the gears are surface-contacted to each other. However, in the case where the shafts of the gears are not parallel to each other, a contact surface between the gears becomes small (hereinafter referred to as end tooth bearing (engagement)).

When the end tooth bearing occurs, harmful effects such that a part of the gear is abraded and that the driving force is periodically fluctuated are undesirably caused.

For this reason, in order to absorb errors in shaft parallelism and engagement parallelism of the tooth surfaces which are generated routinely or accidentally in the gear transmission system, at least one of the driven gear and the driving gear is subjected to the crowning. In this embodiment, the tooth surface of the drum gear 12 has been subjected to the crowning such that the tooth thickness is gradually decreased toward both ends of the drum gear 12 with respect to the gear thickness direction. By constituting the drum gear 12 as a crowning gear, the end tooth bearing by which pressure concentrates at an end portion of the gear with respect to the gear thickness direction is obviated, so that the engagement transmission error between the motor gear 14 and the drum gear 12 is decreased. The drum gear 12 is the crowning gear with an amount of crowning of 70 μm.

<Crowning Gear>

Parts (a) to (d) of FIG. 4 are schematic views for illustrating transmission of gears which have not subjected to the crowning. FIG. 5 is a perspective view of the driven gear which has been subjected to symmetrical crowning.

Parts (a) to (d) of FIG. 6 are schematic views for illustrating the end tooth bearing of the driven gear which has been subjected to the symmetrical crowning. The symmetrical crowning is such that a center position of the gear with respect to the gear thickness direction is taken as a maximum thickness position and the crowning is performed toward left and right ends of the gear with the same tooth thickness reduction ratio. FIG. 7 is a graph showing a measurement result of an alignment error range in which the end tooth bearing does not occur.

In FIG. 4, (a) is an illustration of engagement between the gears, (b) is an enlarged view of a portion A indicated in (a), (c) is an illustration of an engaged state taken along B-B line indicated in (b), and (d) is an illustration of a state in which small tilting occurs at the tooth surface due to a non-parallel state between the shafts during, e.g., assembling and thus the end tooth bearing occurs. That is, (b) of FIG. 4 is a schematic view showing a state in which the contact surface between the tooth surfaces of the gears is decreased due to the alignment error occurring when the gears are assembled with each other in the image forming apparatus. Further, in FIG. 6, (a) shows the symmetrical crowning, (b) shows a state in which there is no tilting at the tooth surface, (c) shows a state in which small tilting occurs at the tooth surface, and (d) shows a state in which large tilting occurs at the tooth surface.

As show in (a) of FIG. 4, the case where a driving gear G1 and a driven gear G2 which have not been subjected to the crowning are engaged with each other to transmit the driving force will be considered.

As shown in (b) of FIG. 4, the gear tooth draws an involute curve and when there is no deformation of the gear tooth, the gears are theoretically contacted to each other at one point. For this reason, at a cross section taken along the B-B line, as shown in (c) of FIG. 4, the tooth surfaces of the driving gear G1 and the driven gear G2 are line-contacted to each other. However, the tooth surfaces are actually deformed by receiving the pressure and thus are contacted in a certain range. This range is referred to as a contact area. The schematic view as shown in (c) of FIG. 4 in which the tooth surfaces are observed to a schematic tooth trace view of the engaged gears.

As shown in FIG. 5, the driven gear G2 has been subjected to the crowning. Thus, as described in JP-A 2004-2583 53, torque non-uniformity and rotational speed non-uniformity due to the end tooth bearing described above are alleviated.

As shown in (a) of FIG. 6, the driven gear G2 which has been subjected to the crowning is the crowning gear having the tooth trace which swells out.

As shown in (b) of FIG. 6, in the case where the driving gear G1 having the tooth trace which is linear and the driven gear G2 having the tooth trace which swells out are engaged with each other, even when small tilting occurs between the driving gear G1 and the driven gear G2, an end tooth bearing state does not arise. For this reason, the crowning gear has an effect of alleviating the engagement transmission error.

That is, in the image forming apparatus, the driving gear G1 and the driven gear G2 cause the alignment error in some cases. The alignment error means that the tooth traces of the engaged gears are not parallel to each other due to tilting of the shaft, deformation with respect to the gear thickness direction, play between the shaft and an inner diameter of the gear, and the like, each of the driving gear G1 and the driven gear G2 which are engaged with each other.

As shown in (d) of FIG. 4, in the case where the engaged gears have not been subjected to the crowning and have the tooth traces which are linear, even when a slight alignment error occurs, the end tooth bearing state such that only an edge of the tooth surface of the driven gear G2 with respect to the gear thickness direction is contacted to the tooth surface of the driving gear G1 arises. When the end tooth bearing arises, the contact area between the tooth surfaces of the driving gear G1 and the driven gear G2 become unstable, so that the engagement transmission error of the gears is increased. With respect to the transmission torque and the transmission rotational speed, torque non-uniformity of an engagement pitch period of the gears and the rotational speed non-uniformity occur.

As shown in (c) of FIG. 6, in the case where the driving gear G1 having the tooth trace which is linear and the driven gear G2 which has been subjected to the crowning and which has the curved tooth trace are engaged with each other, even when the alignment error occurs, the end tooth bearing state does not arise. As shown by an arrow, the torque transmission is performed at an intermediate position of the driven gear G2 with respect to the thickness direction of the driven gear G2 and thus the contact area of the surface contact by pressure is stabilized, so that the engagement transmission error is not increased compared with the case where the gears having the linear tooth traces are engaged with each other as shown in (d) of FIG. 4.

As shown in (c) of FIG. 6, in the case where the alignment error is a certain level or less, the crowning gear does not cause the end tooth bearing (i.e., an abrupt decrease in contact area can be suppressed), so that the engagement transmission error is not so increased. An alignment error range (angular width) in which the crowning gear does not cause the end tooth bearing (i.e., the abrupt decrease in contact area can be suppressed) to achieve an engagement transmission error-decreasing effect is very small in the case of a non-crowning gear. By subjecting the gear to the symmetrical crowning, the alignment error can be allowed by a symmetrical angular width with respect to 0 degrees (0 min.) as the center such that it ranges from, e.g., +30 min. to −30 min. When the crowning center is shifted in the gear thickness direction, e.g., the angular width ranges from +20 min. to −40 min., so that a center angle of the alignment error tolerable region (tolerable angle is deviated).

As shown in (d) of FIG. 6, there is a limit to transmission error-decreasing power of the crowning gear. When a large alignment error to the extent that it cannot be absorbed by the crowning occurs, as shown by an arrow, the end tooth bearing is caused to arise. In the case where the large alignment error occurs, the end tooth bearing arises even with respect to the crowning gear, so that the engagement transmission error-decreasing effect by the crowning is not sufficiently achieved.

The alignment error tolerable region is broadened by increasing an amount of swelling (amount of crowning) of the crowning gear. However, on the other hand, when the crowning amount is increased, a pressure contact area of the tooth surface becomes small and therefore the engagement transmission error is increased. The crowning gear is surface-contacted to the associated gear by being compressed and deformed in a certain range including the contact point as the center. With an increasing surface contact area, the torque transmission becomes smoother, so that the torque fluctuation and the speed fluctuation are also reduced. For this reason, when the crowning amount is increased, the contact area including the contact point as the center is narrowed, so that the torque fluctuation and the speed fluctuation are increased. For that reason, it is desirable that the crowning amount is decreased as small as possible. In (a) to (d) of FIG. 6, a change in tooth thickness is indicated in an exaggerated manner for the sake of easy understanding but actually a difference in tooth thickness is merely about several μm/mm.

As shown in FIG. 7, the alignment error tolerable region was measured by engaging crowning gears having specifications including the module of 0.5, the number of teeth of 96, the pressure angle of 20 degrees, the angle of twist of 20 degrees, the tooth width of 10 mm and the crowning amount of 30 μm. When a slope of the parallelism of the shaft exceeds ±20 min., the end tooth bearing arises and thus the engagement transmission error is abruptly lowered. For this reason, it is understood that the alignment error tolerable region of the parallelism of the shaft of the crowning gear with the crowning amount of 30 μm is about ±20 min. Incidentally, "min." is a unit of the angle and 1 min. is an angle which is 1/60 of 1 degree.

As shown in FIG. 3, in the case where a rotational load is exerted on the drum gear 12 which is the helical gear, a steady alignment error occurs by the drive of the photosensitive drum 1Y. Each of the drum gear 12 and the motor gear 14 is the helical gear with the angle of twist of 20 degrees. The helical gears are obliquely engaged with each other at their tooth surfaces and therefore during the rotational torque transmission, a thrust force with respect to the direction indicated by an arrow R10 is generated at a torque transmitting portion of the drum gear 12. By the steady thrust force, the drum gear 12 which is large in diameter but is relatively small in rigidity is deformed so as to be tilted, thus being in a state in which the tooth surface is tilted. With this state as the center, an alignment error fluctuation during the drive occurs.

Further, in the case where the load is exerted on the drum gear 12 and the motor gear 14 which are engaged at one end, the steady alignment error occurs between the drum gear shaft 10 and the motor gear 14. Both of the drum gear 12 and the motor gear 14 are engaged at one end and therefore are placed in a state in which the engaged tooth surfaces are tilted in a direction in which a center distance of free end sides is increased by the torque transmission. With this state as the center, the alignment error fluctuation during the drive occurs. Incidentally, even when the motor gear 14 by itself has high rigidity, the steady alignment error occurs at the motor gear 14 by bending of a frame to which the motor 13 is attached.

Further, in these states in which the alignment error is out of the alignment error tolerable region (range), as shown in (d) of FIG. 6, the engagement transmission error-decreasing effect of the crowning gear is not sufficiently achieved. In the following embodiments, with respect to the above-described steady alignment errors, the fluctuation in alignment error during the drive is absorbed by offsetting the alignment error tolerable range of the crowning gear, so that the end tooth bearing is obviated.

Embodiment 1

FIG. 8 is a partly enlarged view of the driving system of the photosensitive drum. FIG. 9 is a perspective view of a driven gear which has been subjected to asymmetrical crowning. Parts (a) to (d) of FIG. 10 are illustrations of end tooth bearing of the driven gear which has been subjected to the asymmetrical crowning. FIG. 11 is a graph showing a measurement result of a load torque of a drum motor. Incidentally, in this embodiment, the helical gear is used but with reference to FIGS. 9 and 10, asymmetrical crowning will be described by using the spur gear in place of the helical gear.

As shown in FIG. 8, the drum gear 12 which has been subjected to the crowning and the motor gear 14 which has not been subjected to the crowning are engaged with each other, so that the torque of the motor 13 is transmitted to the drum gear shaft 10. In this embodiment, as a result of analysis described later, it was turned out that a side where a position of the tooth surface of the drum gear 12 with respect to the gear thickness direction in which a maximum pressure is applied approaches the photosensitive drum 1Y by the drive of the photosensitive drum 1Y is on the photosensitive drum 1Y side.

For this reason, on the photosensitive drum 1Y side of the drum gear 12, compared with the fly wheel 15 side, the asymmetrical crowning with respect to the gear thickness direction has been effected so that a decreasing ratio of the tooth thickness with respect to the gear thickness direction is increased. That is, the center position (crowning center CC) of the crowning is shifted from the center position of the drum gear 12 with respect to the gear thickness direction toward the photosensitive drum 1Y side.

Incidentally, the position in which the maximum pressure is applied varies depending on a difference among individuals of the image forming apparatus (e.g., tolerances of assembly and parts). The arrows indicated in (b) to (d) of FIG. 6, (b) to (d) of FIG. 10 and (b) of FIG. 13 represent the position in which the maximum pressure is applied. Incidentally, the maximum pressure-applied position can be measured by using, e.g., pressure sensitive paper. Specifically, the maximum pressure-applied position can be measured by sandwiching the pressure sensitive paper between the gears. By using the pressure sensitive paper, it is also possible to measure a change of the maximum pressure-applied position by the drive.

As shown in FIG. 9, the tooth surface of the drum gear 12 has been subjected to the asymmetrical crowning with respect to the gear thickness direction. With respect to the steady alignment error (caused by a steady force generated by the drive in this embodiment), the crowning center of the drum gear 12 is offset, so that the engagement transmission error-decreasing power is achieved. That is, in consideration of a shaft bending force which is steady generated by the driver or the like, the alignment error tolerable range (angle) is adjusted. Specifically, a minimum crowning position (maximum tooth thickness position) is shifted from the center, with respect to the gear thickness direction, in the direction indicated by an arrow D by 3 mm. In this movement direction of the crowning center cc, the position, with respect to the gear thickness direction, in which the maximum pressure is applied to the tooth surface is offset toward the side where the drum gear 12 approaches the photosensitive member by the drive of the photosensitive member.

In the case of the symmetrical crowning with respect to the gear thickness direction shown in (a) of FIG. 6, when a large alignment error occurs as shown in (d) of FIG. 6, the contact position indicated by the arrow reaches the end (edge) with respect to the gear thickness direction, so that an end tooth bearing state is formed. On the other hand, in the case of the asymmetrical crowning with respect to the gear thickness direction shown in (a) of FIG. 10, even when the large alignment error occurs as shown in (d) of FIG. 10, the contact position is within an intermediate position, so that the end tooth bearing state is obviated.

As shown in FIG. 12, the rotation speed non-uniformity-reducing effect was checked in the image forming apparatus 100 including the drum gear 12 which was the crowning gear with the minimum crowning position (maximum tooth thickness position) shifted in the arrow D direction by 3 mm. A fixed-pitch horizontal line toner image of a 2-scanning line width is outputted at a 4-scanning line pitch and is subjected to measurement of a pitch distance thereof by measuring reflected laser light from the photosensitive drum 1Y. The resultant data is subjected to discrete Fourier transform, thus being shown in the graph of FIG. 12.

Part (a) of FIG. 12 shows a measurement result in Comparative Embodiment in which the drum gear 12 having the minimum crowning position at the center thereof with respect to the gear thickness direction is used. Part (b) of FIG. 12 shows a measurement result in Embodiment 1 in which the drum gear 12 having the minimum crowning position which is shifted from the center by 3 mm in the arrow D direction shown in FIG. 8.

In Embodiment 1 of (b) of FIG. 12, compared with Comparative Embodiment of (a) of FIG. 12, it was turned out that the pitch non-uniformity at 216 Hz which was an engagement frequency between the drum gear 12 and the motor gear 14 was alleviated. The photosensitive drum 1Y is rotated at 0.89 rotation per second and therefore the engagement frequency is determined as 216 Hz from the number of teeth of the drum gear 12 of 192. At the engagement frequency, the scanning line pitch non-uniformity indicated by an arrow is 0.45 μm in Comparative Embodiment and is 0.3 μm in Embodiment 1. Thus, a degree of the pitch non-uniformity in Embodiment 1 is reduced by about 30% from that in Comparative Embodiment.

<Amount of Offset>

FIG. 11 is a graph showing a measurement result of a load torque of the drum motor. Parts (a) and (b) of FIG. 13 are illustrations of deformation of the drum gear.

Study made for determining the amount of offset of the minimum crowning position (maximum tooth thickness position) is shown. The drum gear 12 is the helical gear with the angle of twist of 20 degrees and therefore a thrust force (urging force in axial direction) is generated by the torque, so that the drum gear 12 is deformed so as to be tilted toward the fly wheel 15 side and thus the steady alignment error in tooth surface occurs.

As shown in FIG. 11, as a result of measurement of a load torque of the drum motor 13 by actuating the image forming apparatus 100 for 40 seconds, the load torque of 0.09 N (about 9 kgf·min) was applied. When this torque is converted into a thrust force F, the following formula is satisfied.

$$F = 9 \times \frac{\cos 20^\circ}{0.6 \times 12} \times 2 \times \sin 20^\circ = 8.00 \times 10^{-1}\text{kgf}$$

As a result of calculation through finite element analysis of an amount of tilt deformation when the thrust force of 8N (about $8.0\times10^{-1}$ kgf) was applied to the drum gear 12, as shown in (a) of FIG. 13, it was turned out that tilt in a distance of $4.04\times10^{-2}$ mm with respect to the axial direction occurred. Therefore, as shown in (b) of FIG. 13, the minimum crowning position (maximum tooth thickness position) of the crowning gear is shifted to one side with respect to the gear thickness direction. The maximum crowning position is shifted from the center of the gear thickness direction toward a direction opposite from a direction of an occurrence of thrust load of the helical gear on the drum gear 12 (i.e., the side opposite from a side where the drum gear 12 is deformed in the axial direction).

A steady alignment error (tooth surface angle of twist) δ caused by tilting of the drum gear 12 due to the helical gear is represented by the following formula.

$$\delta = 4.04 \times 10^{-2} \frac{\cos 20^\circ}{0.6 \times 192} \times 2 = 6.59 \times 10^{-4}\text{rad} = 0.0378^\circ$$

Incidentally, the amount of tilting of the motor gear 14 is small to the extent that it is negligible compared with that of the drum gear 12 and therefore details thereof will be omitted from description. This is because the motor gear 14 is formed of metal and therefore has Young's modulus which is about 100 times that of the motor gear formed of resin, and an application point of the thrust force is close to the rotation center and therefore the moment in the tilting direction is also very small.

Next, each of the drum gear 12 and the motor gear 14 is supported at one end and therefore free end sides of the gears are tilted toward a direction, in which the center distance is increased, by an engagement pressure angle, so that the steady alignment error occurs. A force F exerted on each gear shaft is represented by the following formula.

$$F = 9 \times \frac{\cos 20^\circ}{0.6 \times 12} \times 2 \times \sin 20^\circ = 8.00 \times 10^{-1}\text{kgf}$$

By using the finite element analysis, the degree of the tilting when the tilting force of 8N ($8.00\times10^{-1}$ kgf) in a direction spaced from the drum gear shaft and the motor gear 14 was calculated. As a result, it was turned out that the tilting of the drum gear shaft 10 was $1.60\times10^{-3}$ mm and the tilting of the motor gear 14 was $1.46\times10^{-3}$ mm.

The steady alignment error (tooth surface angle of twist) δ is represented by the following formula.

$$\delta = \frac{1.60 \times 10^{-3}}{20} + \frac{1.46 \times 10^{-3}}{30} = 1.29 \times 10^{4}\text{rad} = 0.00739^\circ$$

Next, to the drum gear shaft 10, the weight of the fly wheel 14 is applied and therefore the drum gear shaft 10 is tilted toward a direction in which the distance between the gear shafts is decreased, so that the steady alignment error (tooth surface angle of twist) occurs.

By using the finite element analysis, the degree of the tilting when the load of the fly wheel 15 is applied to the drum gear shaft 10 was calculated. As a result, it was turned out that the drum gear shaft 10 was tilted by $8.48\times10^{-3}$ mm.

The steady alignment error (tooth surface angle of twist) δ caused by the tilting of the drum gear shaft 10 is represented by the following formula.

$$\delta = \frac{8.48 \times 10^{-3}}{72} = 1.18 \times 10^{-4}\text{rad} = 0.00676^\circ$$

When an offset amount Σ of the minimum crowning position (maximum tooth thickness position), from the center of the gear with respect to the gear thickness direction, necessary to cancel the three steady alignment errors are calculated, it can be obtained by the following formula when the direction indicated by the arrow D in FIG. 8 is taken as positive.

$$\sum = (6.59 \times 10^{-4} + 1.29 \times 10^{-4} - 1.18 \times 10^{-4}) \times \frac{0.6 \times 192}{\cos 20^\circ} \times \frac{1}{2} \times 70 = 2.87\text{mm}$$

Based on the above results, as described above, the minimum crowning position was shifted in the D direction shown in FIG. 8 by 3 mm. Further, as described above with reference to FIG. 11, the effect of reducing the scanning line pitch non-uniformity at the engagement frequency of 216 Hz by about 30% was obtained.

Incidentally, in this embodiment, the example in which the driving side gear has been subjected to the crowning is described but it is also possible to subject the driven side gear to the crowning. Further, both of the driving side gear and the driven side gear may also be subjected to the crowning.

Embodiment 2

FIG. 14 is an illustration of a structure of an intermediary transfer unit.

As shown in FIG. 14, a supporting casing 56 of an intermediary transfer unit 50 rotatably supports a tension roller 52 and a driving roller 54. The driving roller 54 for driving an intermediary transfer belt 55 which is an example of a belt member is driven by a motor driving mechanism 57. The motor driving mechanism 57 rotates the driving gear 54 by engaging a motor gear 64 of a motor 63 with a roller gear 62 fixed to a roller shaft 60 to transmit an output torque of the motor 63 to the roller shaft 60.

The roller shaft 60 is rotatably supported by the supporting casing 56 by using a bearing 68. The motor 63 is fixed to the supporting casing 56, and the motor gear 64 which is an example of the driving gear is directly formed on the motor driving shaft. The roller gear 62 which is an example of the driven gear is engaged with the motor gear 64 and is rotated integrally with the driving roller 54.

The motor gear 64 formed by being cut from an output shaft of the motor 63 has not been subjected to the crowning and the roller gear 62 formed by resin molding has been subjected to the crowning. Further, the minimum crowning position (maximum thickness position) of the roller gear 62 is shifted from the center of the gear, with respect to the gear thickness direction, toward the direction of the motor 63.

The gear specifications of the motor gear 64 are the outer diameter of 10 mm, the module of 0.6, the pressure angle of 20 degrees, the number of teeth of 12 and the angle of twist of the helical gear of 30 degrees.

The gear specifications of the roller gear 62 are the outer diameter of 43 mm, the thickness of 10 mm, the module of 0.6, the pressure angle of 20 degrees, the number of teeth of 60 and the angle of twist of the helical gear of 30 degrees.

Embodiment 3

In Embodiment 1, the suppression of the rotational speed fluctuation of the photosensitive drum attached to the casing structure of the image forming apparatus was described. However, the present invention is also applicable to a driving portion of the photosensitive drum attached to the casing structure of a process cartridge. In either case, the amount of the steady alignment error may only be required to be estimated by using the above-described analysis method to determine the shift amount of the crowning center depending on the result of the estimation.

Further, in the case of the resin molding, there is no need to effect the crowning by cutting of the material and therefore it is possible to inexpensively manufacture the gear which has been subjected to the crowning. Further, the gear of the resin material has the Young's modulus smaller than that of the metal shaft, so that the contact area by the compression deformation is increased and thus the speed fluctuation for torque transmission may be small. However, the gear of the metal shaft may also be subjected to the asymmetric crowning. By subjecting at least one of the engaged gears to the asymmetric crowning, speed fluctuation noise is suppressed.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 088446/2010 filed Apr. 7, 2010, which is hereby incorporated by reference.

What is claimed is:

1. An image forming apparatus driving unit comprising:

a rotatable member which is rotatably supported;

a pair of bearing portions for rotatably supporting said rotatable member;

a motor for driving said rotatable member;

a driving gear provided on a driving shaft of said motor; and a driven gear, provided outside said pair of bearing portions with respect to a rotational axis direction of said rotatable member, for engaging with said driving gear to be rotated integrally with said rotatable member, wherein at least one of said driven gear and said driving gear has, with respect to the rotational axis direction of said rotatable member, a crown shape so that a central tooth surface of a tooth projects more than end tooth surfaces of the tooth at a side where said driven gear and said driving gear engage each other, and wherein during driving of said driving gear, a first position where a pressure received by the tooth surface is at a maximum and a second position where an amount of crowning formed on said driven gear or said driving gear is at a maximum are offset in a same direction.

2. The driving unit according to claim 1, wherein said rotatable member is an image bearing member for bearing an image.

3. The driving unit according to claim 1, wherein said rotatable member is a driving roller for driving a belt member.

4. The driving unit according to claim 1, wherein with respect to the rotational axis direction of said rotatable member, an amount of a change in tooth thickness from the first position, where the pressure received by the tooth surface is at a maximum, to one of the end tooth surfaces is substantially equal to an amount of a change in tooth thickness from the first position, where the pressure received by the tooth surface is at a maximum, to the other of the end tooth surfaces.

5. The driving unit according to claim 1, wherein the central tooth surface projects more than the end tooth surfaces along a substantially entire lateral face of the tooth.

6. An image forming apparatus driving unit comprising:

a rotatable member which is rotatably supported;

a pair of bearing portions for rotatably supporting said rotatable member;

a motor for driving said rotatable member;

a driving gear provided on a driving shaft of said motor; and a driven gear, provided outside said pair of bearing portions with respect to a rotational axis direction of said rotatable member, for being engaged with said driving gear to be rotated integrally with said rotatable member, wherein at least one of said driven gear and said driving gear has, with respect to the rotational axis direction of said rotatable member, a crown shape so that a central tooth surface of a tooth projects more than end tooth surfaces of the tooth at a side where said driven gear and said driving gear are engaged with each other, and wherein a first position where an amount of crowning of each tooth of said driven gear or said driving gear is at a maximum is, with respect to the rotational axis direction of said rotatable member, offset at a side where said rotatable member is provided.

7. The driving unit according to claim 6, wherein said rotatable member is an image bearing member for bearing an image.

8. The driving unit according to claim 6, wherein said rotatable member is a driving roller for driving a belt member.

9. The driving unit according to claim 6, wherein with respect to the rotational axis direction of said rotatable member, an amount of a change in tooth thickness from the first position, where a pressure received by the tooth surface is maximum, to one of the end tooth surfaces is substantially equal to an amount of a change in tooth thickness from the first position, where a pressure received by the tooth surface is maximum, to the other of the end tooth surfaces.

* * * * *